340-553 SR
11/25/80 OR 4,236,147

United States Patent [19]

Calvin

[11] 4,236,147

[45] Nov. 25, 1980

[54] AUTOMATIC DOORBELL

[76] Inventor: Noel Calvin, 2863 Buena Vista, Berkeley, Calif. 94708

[21] Appl. No.: 858,958

[22] Filed: Dec. 9, 1977

[51] Int. Cl.[2] ..... G08B 3/00; G08B 13/18

[52] U.S. Cl. ..... 340/553; 340/384 E

[58] Field of Search ..... 340/552, 553, 561, 384 E; 343/5 PD, 225; 49/25

[56] References Cited

U.S. PATENT DOCUMENTS

| | | | |
|---|---|---|---|
| 3,237,191 | 2/1966 | Bojko | 340/553 X |
| 3,300,768 | 1/1967 | Bystrom et al. | 340/552 X |
| 3,497,995 | 3/1970 | Forsberg | 343/5 PD X |
| 3,747,109 | 7/1973 | Corbell et al. | 343/5 PD X |
| 3,815,130 | 6/1974 | Hayo | 343/5 PD |
| 3,981,007 | 9/1976 | Cieslak et al. | 340/384 E |
| 4,001,817 | 1/1977 | Squires | 340/384 E |
| 4,087,814 | 5/1978 | Spirig | 343/5PD |

*Primary Examiner*—John W. Caldwell, Sr.
*Assistant Examiner*—Joseph E. Nowicki
*Attorney, Agent, or Firm*—Herzig & Walsh, Incorporated

[57] ABSTRACT

Microwave transmitting means, receiving means, and detector means such that the change in the standing wave pattern surrounding said transmitting means caused by the approach of a person on one side of said transmitting means can be detected and distinguished from the approach of a person on the other side, and tone generator means such that an audible tone is generated when a person approaches from one side, but not when a person approaches from the other, adaptable for use as an automatic doorbell.

3 Claims, 6 Drawing Figures

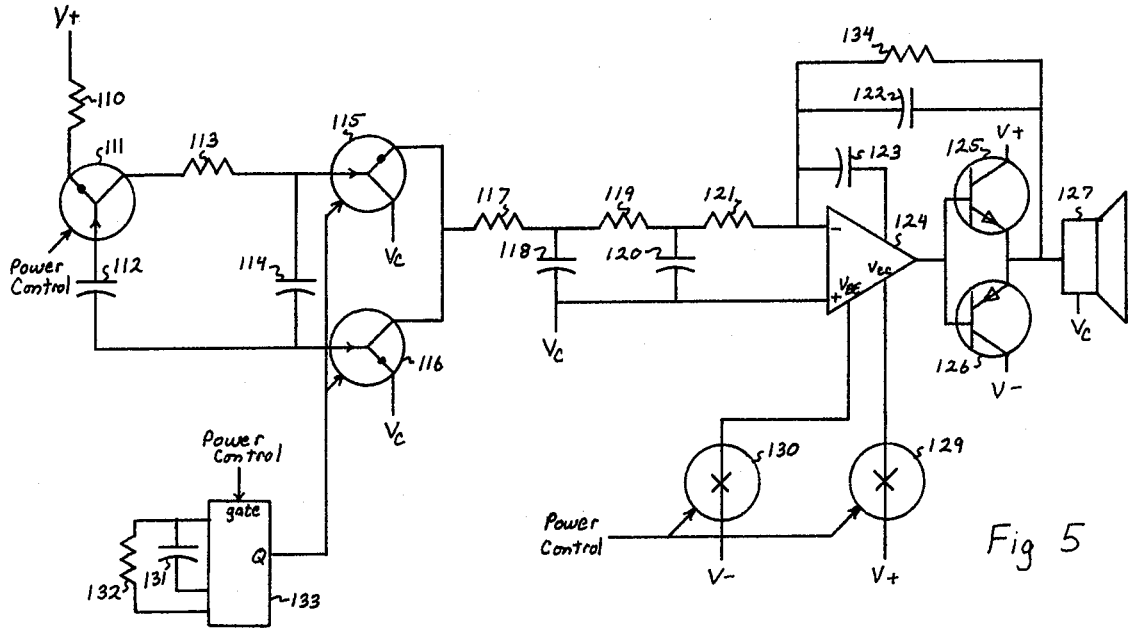
Fig 5
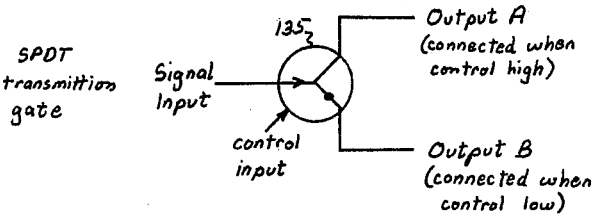
Fig 6
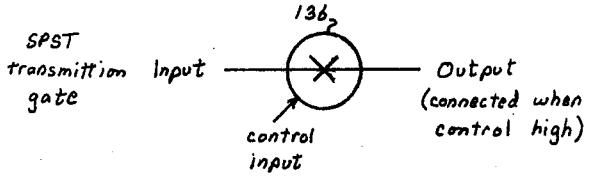

AUTOMATIC DOORBELL

BACKGROUND OF THE INVENTION

The necessity for some means by which someone on the outside of a door could notify someone on the inside of his presence has been recognized for centuries. The earliest solution to this problem consisted of the simple expedient of knocking on the door with one's fist. As the human race grew in wisdom and technical sophistication, new and subtler methods were invented. The first of these was the mechanical door knocker, which saved man untold pain from bruised knuckles. Then with the advent of electronics came the electrical door bell, the evolution of which over the past two decades has seen the invention of a number of methods capable of detecting the approach of a person to a door at a distance and triggering the production of an appropriate sound on the inside of the door. Unfortunately, all such methods devised so far suffer from disadvantages which have prevented their widespread application to residential doors.

These methods can be divided into three categories on the basis of the principle used to detect the approaching person. The first category involves the use of a mechanical switch which is activated when the person steps on it. The second involves the use of a photoelectric sensor and a light source arranged so that the person casts a shadow on the sensor as he approaches the door. The third involves some type of capacitance proximity sensor which detects the change in capacitive coupling between a metal sensor plate and ground, or between two plates mounted on or near the door, that results when a person approaches them.

None of the three categories has achieved wide acceptance in residential applications, principally because they are all difficult to install, limiting their usefulness primarily to those instances when they can be built in during the construction of the building.

The mechanical switch method requires that a mat containing many such switches be placed in front of the door in such a way that anyone approaching the door must step on it. Not only are such mats highly unaesthetic, but it must be connected to the sound producing unit inside the house, requiring that a hole be drilled through a wall. This sort of installation is beyond what most homeowners have the time or skill to attempt, and is therefore usually done by professionals, greatly increasing total cost.

The photoelectric method requires that a light source and photodetector be mounted on either side of the path leading to the door. Here again, installation is usually done by professionals, and unless it is possible to hide the units in shrubbery, the light source and detector can be even more unaesthetic than a mat.

Installation of a doorbell based on a capacitance proximity sensor is somewhat simpler than that of a mechanical switch or photoelectric unit in that the entire device can be mounted on the inside of the door. However, in order to obtain even the minimal detection range of two feet, metal sensor plates of several square feet must be used, and while these cannot be seen from the outside they are painfully obvious from the inside.

In order to overcome the disadvantages of the methods discussed, it is clear that the ideal automatic doorbell would consist of a single small battery-operated unit, requiring no electrical connections at all. Installation would consist of driving a nail into the door and hanging the unit from it. The automatic doorbell herein described seeks to meet these criteria.

SUMMARY AND OBJECTS OF THE INVENTION

The invention relates to a method for detecting the approach of a person on the outside of a closed door and producing a pleasing tone on the inside of the door when such an approach is detected, adaptable to function as an automatic doorbell.

The method involves the use of a microwave proximity sensor capable of detecting the approach of a person within approximately six feet, and able to differentiate between a person on one side and a person on the other side of the sensor, and a tone generator connected to the sensor such that an audible tone is generated when the approach of a person on one side of the sensor is detected, but not when the approach is made from the other side.

The proximity detector is comprised of a micropower transmitter operating in the S band, two receiving antennas and a comparator circuit. The receiving antennas are mounted on opposite sides of a rectangular metal shield, approximately one-half wavelength on a side. The transmitting antenna is positioned in the plane of the shield and far enough away from it to prevent loading.

The strength of the signal present at each receiving antenna is equal to the sum of the signal arriving directly from the transmitting antenna with all signals reflected back to the antenna from nearby objects. A given reflected signal will increase the total signal strength if it is in phase with the direct signal, and will decrease the strength if it is 180° out of phase. If it is 90° out in either direction it will have no effect at all. The phase of the reflected signal relative to the direct signal is determined by the total distance the signal travels from the transmitting antenna, to the reflecting object, and back to the receiving antenna. If that total distance is an even number of half-wavelengths longer than the distance from the receiving antenna to the transmitting antenna, the reflected and direct signals will be in phase and they will add, increasing the signal strength at the receiving antenna. If the total distance is equal to an odd number of half-wavelengths more than the distance between antennas, the signals will be 180° out of phase, and will therefore cancel, reducing the signal strength.

When a person walks toward the sensor, the total distance the signal relected from him travels is constantly changing. As this distance alternates between an even and an odd number of half-wavelengths the reflected signal will alternately increase and decrease the signal strength at the receiving antenna. This oscillation in strength will have a frequency proportional to the speed at which the person is moving and an amplitude proportional to his distance from the sensor. Because of the shield between the receiving antennas, each antenna will receive reflections only from objects on its side of the shield. A person moving on one side will therefore cause an oscillation in the signal strength at the antenna on his side; the strength at the antenna on the opposite side will remain constant.

The output of each antenna is rectified and converted into a dc voltage proportional to the signal strength at the antenna. The two dc voltages are fed into the comparator, which detects changes in the voltages resulting from the motion of a person near the antennas. The comparator contains a memory and a timer, and is connected to the tone generator. If motion is first detected on the outside of the door, the comparator will activate the generator. In order to prevent the continuous activation of the tone generator by a person waiting in front of the door, the memory and timer prevent the reactivation of the tone generator for a fixed interval after the initial activation.

If motion is first detected on the inside of the door, the tone generator is not activated, and the memory and timer prevent its activation for a time interval after motion was last detected on the inside. The reason for this is that in order to go out through a door and close it, it is necessary to move in front of the door. Inhibiting the tone generator for a period after motion is detected on the inside prevents a tone from sounding when someone goes out the door.

The tone generator is designed to produce a sound resembling the "bong" produced by some mechanical doorbells. This bong consists of a sine wave of low harmonic content whose amplitude increases rapidly at the start, and thereafter slowly decreases.

The proximity sensor and tone generator draw an extremely small amount of power except when a sound is being produced, allowing the device to operate off a single set of batteries for years.

The primary object of the invention is to provide a means for detecting the approach of a person on the outside of a door and for generating a pleasing tone when such an approach is detected.

A further object is to allow said means to be housed in a single small container, self contained and battery operated, eliminating the need for the installation of any components outside of the door, and enabling said means to be installed without any wiring whatsoever.

A further object is to enable said means to distinguish between the approach of a person on the inside of the door and an approach made on the outside, such that a tone is generated only when the door is approached from the outside, but not when the door is approached or opened from the inside.

A further object is to allow said means to operate off batteries by reducing the power drain to a very low level.

A further object is to enable said means to produce a pleasing tone resembling the "bong" produced by some mechanical doorbells.

BRIEF DESCRIPTION OF THE DRAWINGS

FIG. 5 is a schematic diagram of the tone generator.

FIG. 6 is an explanation of the symbolic representation used for CMOS transmission gates.

DETAILED DESCRIPTION OF THE PREFERRED EMBODIMENT

Figure 1:
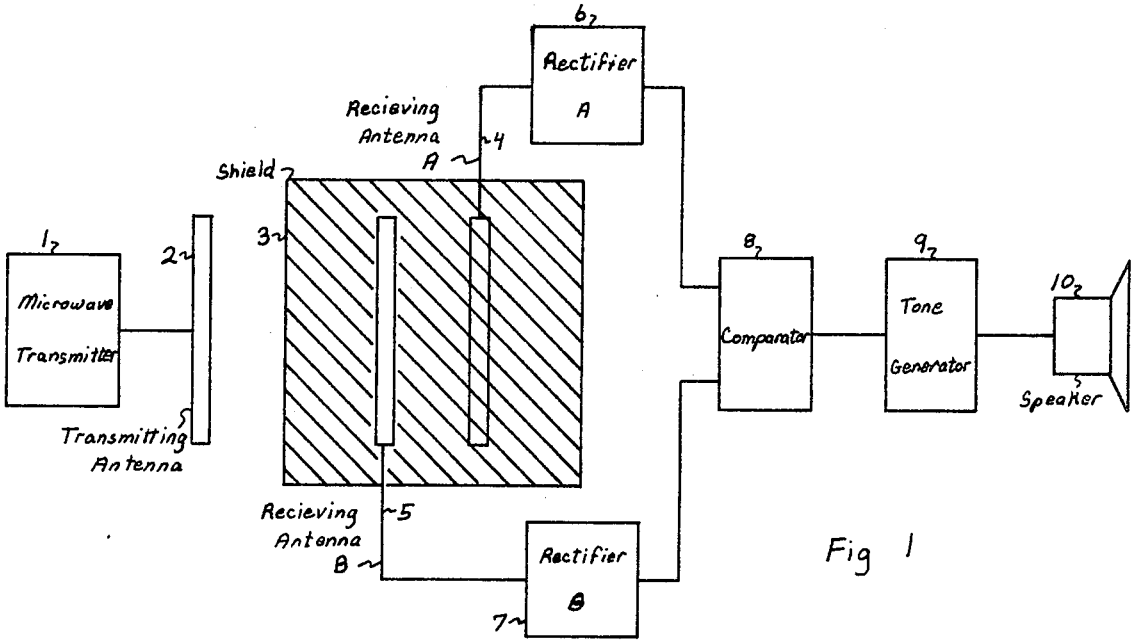
FIG. 1 is a block diagram of the preferred embodiment.

A block diagram of the preferred embodiment of the automatic doorbell is shown in FIG. 1. The device consists of an ultra low power microwave transmitter 1 and the associated transmitting antenna 2, two receiving antennas 4 and 5, separated by a shield 3, two rectifiers 6 and 7 associated with the receiving antennas, a comparator circuit 8, a tone generator 9, and a speaker 10.

The microwave transmitter operates in a pulsed mode such that the peak transmitted power is several tens of milliwatts, while the average power is only a few microwatts. The signals picked up by the receiving antennas are rectified by the rectifiers so as to produce a voltage proportional to the peak value of the received signal. The approach of a person to the antennas will cause a change in the strength of the signal at the antenna on the side of the shield facing the person, which will be reflected in a change in the output voltage of the associated rectifier. When the comparator detects a change in the output of the rectifiers associated with the approach of a person on the outside of the door, it activates the tone generator, which drives the speaker, producing an audible warning tone.

Figure 2:
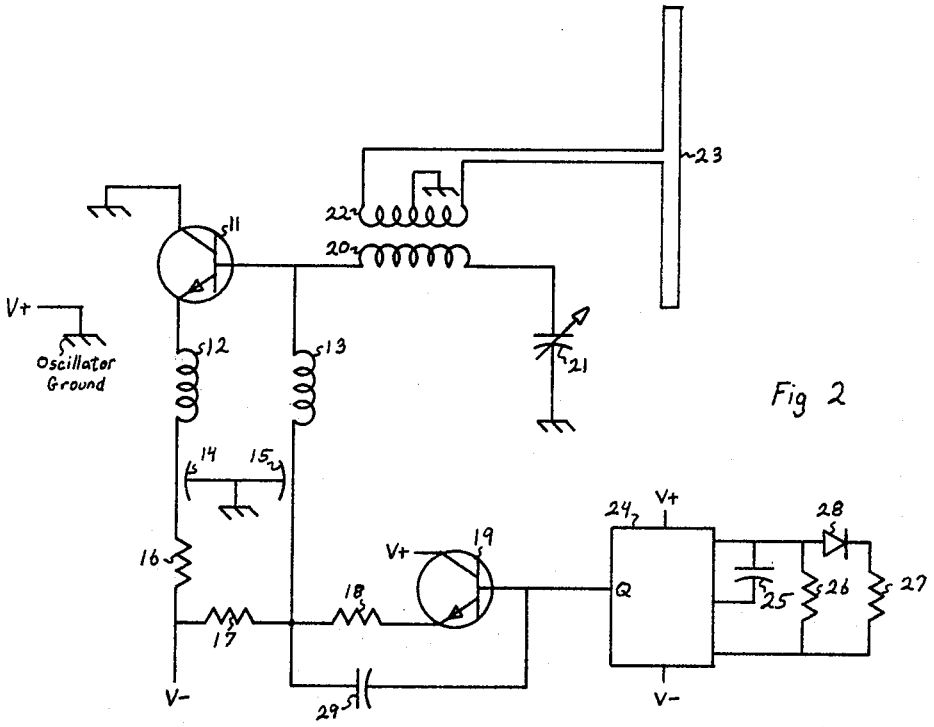
FIG. 2 is a schematic diagram of the transmitter.

The schematic diagram of the microwave transmitter is shown in FIG. 2. The transmitter is a standard lumped constant oscillation operating in the S band. Because of the physical geometry of the oscillator it is necessary for the ground plane of the oscillator to be at the positive power supply potential, as is shown in the schematic; the oscillator ground should not be confused with the general ground connection used in the rest of the circuitry, which is the standard negative ground.

Oscillator transistor 11 is a standard low power microwave amplifier transistor such as type 2N5108. Radio frequency chokes 12 and 13 provide power supply and bias decoupling, respectively. Feed through capacitors 14 and 15 bypass the power and bias lines to the ground plane. Resistor 16 sets the operating current through the transistor, and resistors 17 and 18 form a voltage divider which sets the bias voltage. Inductor 20 and variable capacitor 21 form the oscillator tank circuit. Power is coupled to a $\frac{1}{4}$-wave folded dipole antenna 23 through a balanced transformer 22.

Integrated circuit 24 is a standard CMOS micropower miltivibrator, industry standard type #4047, connected so as to produce a train of positive going pulses with a duty cycle of a fraction of one percent. These pulses are fed through emitter follower 19 into the voltage divider formed by resistors 17 and 18. During a pulse the voltage divider biases the oscillator transistor 11 on, and the transmitter is turned on. Between pusles the transistor is biased off, the transmitter does not operate, and therefore draws no power from the battery. Capacitor 29 ensures that the oscillator shuts off at the end of a pulse by briefly reverse biasing transistor 11. The frequency of the pulse train is set by resistor 26 and capacitor 25; the duty cycle is controlled by signal diode 28 and resistor 27. The average power drain of the transmitter is equal to the peak power times the percent duty cycle. Thus, if the peak power is 50 milliwatts and the duty cycle is 0.1%, the average power will be only 50 microwatts—a negligible drain on penlight size batteries.

Figure 3:
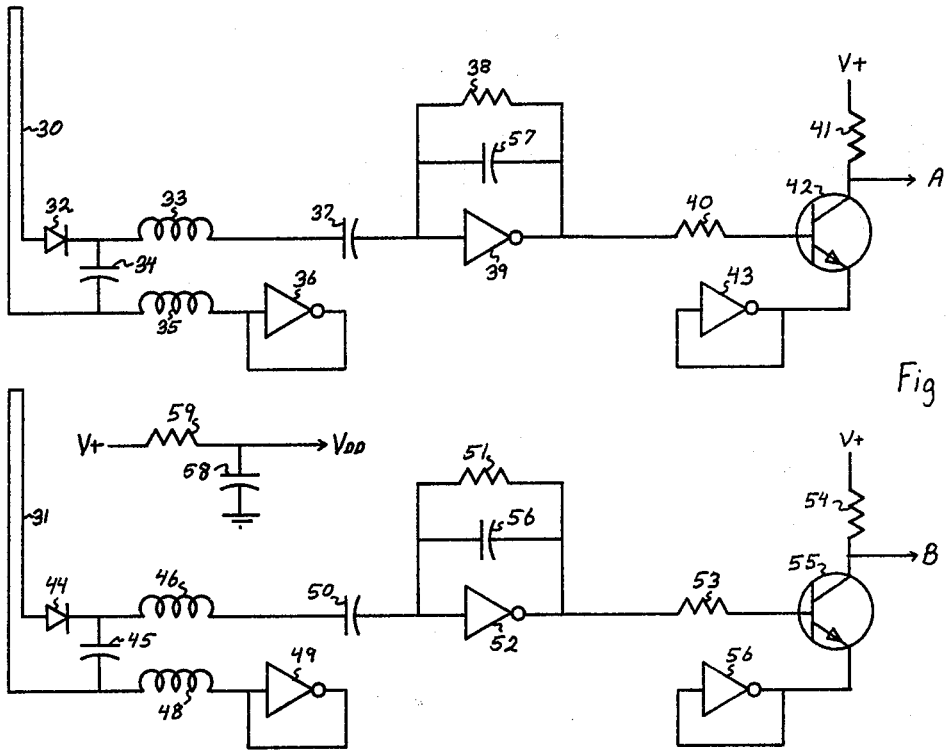
FIG. 3 is a schematic diagram of the receivers.

The receiving antennas, rectifiers, and the analog portion of the comparator circuitry are shown in FIG. 3. Antennas 30 and 31 are $\frac{1}{4}$ wavelength folded dipoles similar to the transmitting antenna. The output of each antenna is rectified by the associated diode and capacitor, diode 32 and capacitor 34 for antenna 30, and diode 44 and capacitor 45 for antenna 31. The diodes should be of the shottky-barrier type, and should be mounted as close to the antenna as possible. Capacitors 34 and 45 serve to store the charge delivered during a transmitter pulse, and should also be mounted very close to the antenna. Radio frequency chokes 33, 35, 46, and 48 decouple the antennas from the wires connecting them to the rest of the circuitry, preventing these wires from acting as part of the antenna system. The chokes should be mounted very close to the antennas.

The outputs of the rectifiers are AC coupled through capacitors 37 and 50 to micropower amplifiers formed around CMOS invertors 39 and 52. The DC bias on the amplifiers is maintained by resistors 38 and 51, and the high frequency cut off point is set by capacitors 57 and 56. In order to improve the power supply rejection ratio and prevent oscillation the DC return for the rectifiers is through CMOS invertors 36 and 49. With the output shorted to the input, CMOS invertors 36 and 49 act as low impedance sources of a bias voltage exactly equal to the balance point on the tranfer curve. Since the balance point is proportional to the supply voltage, changes in the supply voltage will be interpreted by a CMOS amplifier as changes in the input and amplified accordingly, often causing oscillation. Since the output of gates 36 and 49 tracks the balance point during variations caused by supply voltage fluctuations, connecting the rectifier return to these gates effectively cancels these fluctuations.

The outputs of invertors 39 and 52 are fed through current limiting resistors 40 and 53 into the bases of transistors 42 and 55. The emitters of the transistors are connected to invertors 43 and 56, which act as bias voltage sources. Resistors 41 and 54 are collector pull up resistors.

All six invertors in FIG. 3 share common power supply lines and are part of a CMOS hex-invertor integrated circuit, industry standard type 4069 or equivalent. Power is fed to the common VDD terminal through resistor 57. Feedback via the power supply between invertors is prevented by by-pass capacitor 58. All six invertors are biased in the middle of their linear region, and the total power dissipation is therefore a function of the supply voltage. Dissipation rises very quickly from near zero at about 3.5 volts to several milliwatts at 4.0 volts. The total dissipation is therefore set by the value of resistor 59 and the main supply voltage. Since the unit must operate continuously off batteries for periods exceeding 1 year, resistor 59 should be chosen to give a dissipation of between 10 and 50 microwatts. This results in a supply voltage of about 3.6 volts to the invertors, and a bias voltage of about 2.0 volts. Under these conditions, invertors 39 and 52 will function as inverting amplifiers with a voltage gain of about 30.

Under static conditions capacitors 37 and 50 will change to whatever voltage is generated across capacitors 34 and 45 by the associated antennas and diodes. The outputs of invertors 39 and 52 will therefore be equal to the bias voltage, no current will flow through resistors 40 and 53, transistors 42 and 53 will be cut off, and the voltage at points A and B will equal the supply voltage.

When someone approaches the antennas, the signal strength at whichever antenna is on the side of the shield facing the person will begin to change. For example, assume that the signal at antenna 30 is going down. The voltage across capacitor 34 will decrease. Assuming that the rate of the change is considerably faster than the time constant of capacitor 37 and resistor 38, the voltage at the input of invertor 39 will go down as well. Whatever change occurs at the input of the invertor will appear inverted and amplified approximately 30 times at the output. If the input goes down by 20 mv, the output will rise to 0.6 volts above the bias voltage, the base emitter function of transistor 42 will begin to conduct, and current will start to flow through collector pull up resistor 41. If resistor 41 is made very large—on the order of a few megohms, and a high gain transistor is used, an initial change of 25 vm will be sufficient to cause transistor 42 to go into saturation, bringing the voltage at point A to within a few tenths of a volt of the bias voltage. The voltage at point B will remain high. If the approach is made from the other side, the voltage at B will go low, while A remain high.

Figure 4:
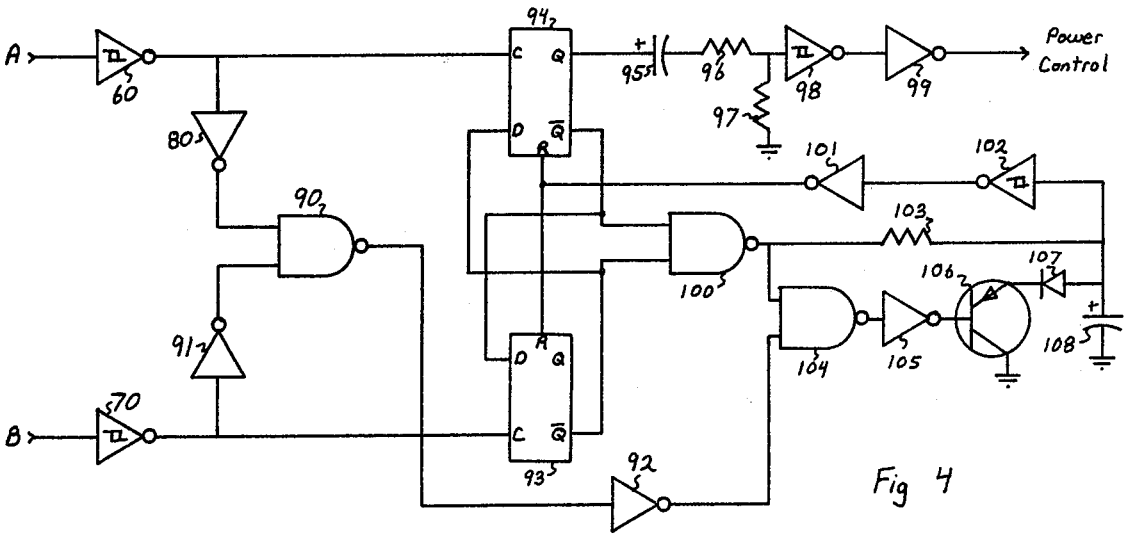
FIG. 4 is a schematic diagram of the comparator.

The voltages at points A and B are fed into the digital portion of the comparator, the schematic of which is shown in FIG. 4. This section of the circuitry performs the timing and comparison functions necessary to insure that the tone generator is triggered only once when a person approaches the door from the outside, and to prevent its being triggered when the door is approached and/or opened from the inside. In the following explanation it is assumed that the antennas are so oriented that an approach from the outside causes the A output to go low, while an approach from the inside causes the B output to go low.

Referring to FIG. 4, points A and B are connected to the inputs of standard CMOS schmidt triggers 60 and 70, which invert the signals and provide them with the fast rise and fall times required by CMOS flip flops. The outputs of the schmidt triggers are connected to the clock inputs of standard CMOS D-type flip flops 94 and 93. The D input of each flip flop is connected to the inverted output of the other flip flop, making a three state memory cell. If neither the A or B input has gone low, the uninverted outputs of both flip flops remain low. If input A goes low first, the output of flip flop 94 goes high, and the output of flip flop 93 is locked low. If input B goes low first, the output of flip flop 93 goes high, and flip flop 94 is locked in the low state.

Whenever either of the flio flops goes high it is automatically reset after a time interval by a time consisting of CMOS NAND gates 100 and 104, CMOS invertors 105 and 101, CMOS schmidt trigger 102, transistor 106, diode 107, capacitor 108, and resistor 103.

This timer is reset and forced to restart the time interval from the beginning whenever either input A or B goes low by CMOS invertors 80, 91, and 92, and CMOS NAND gate 90. Thus, the flip flops will be reset after an interval which begins from the last time either input A or B went high.

The tone generator is activated for a short period of time after the output of flip flop 94 goes high by a timer composed of resistors 96 and 97, capacitor 95, CMOS schmidt trigger 98, and invertor 99.

The operation of the comparator is as follows:

Initially, both inputs A and B are high, flip flops 93 and 94 are both reset, and capacitors 95 and 108 are fully discharged.

Assume now that someone approaches the outside of the door; input A goes low, causing the output of schmidt trigger 60 to go high. The inverting output of flip flop 94 goes low, locking flip flop 93 in the low state; the non-inverted output of flip flop 94 goes high, causing the input to schmidt trigger 98 to go high, resulting in the output of invertor 99 going high, turning on the tone generator. Capacitor 95 immediately begins to charge through resistors 96 and 97. When the voltage at the input to schmidt 98 reaches about $\frac{1}{3}$ the supply voltage, the schmidt changes state, causing the output of invertor 99 to go low, turning off the tone generator. The time interval for which the tone generator is turned on is set by capacitor 95 and resistor 97; resistor 96 is small compared with resistor 97 and serves only to protect schmidt 98 when the output of flip flop 94 goes low, and capacitor 95 discharges through resistor 96 and the input protection diodes of schmidt 98.

When the inverted output of either flip flop goes low, the output of NAND 100 goes high, and capacitor 108 starts to charge through resistor 103.

However, if either inputs A or B go low, the output of NAND gate 90 will go high, invertor 92 will go low, NAND 104 will go high, and invertor 105 will go low, causing capacitor 108 to discharge through diode 107 and transistor 106.

If both inputs A and B remain high long enough, capacitor 108 will charge to about $\frac{2}{3}V+$, at which time schmidt trigger 102 will change state, causing invertor 101 to go high, resetting both flip flops. Since the inverting outputs of both flip flops are now high, the output of NAND 100 goes low, causing NAND 104 to go high, resulting in capacitor 108 being discharged through the associated diode and transistor. Schmidt 102 again changes state, and invertor 101 goes low, allowing either of the flip flops to be triggered by an input signal.

If the initial approach is made from inside, input B will go low, and the output of flip flop 93 will go high. The timing sequence is identical to that described for initial activation of input A, except that the output of flip flop 94 remains low and the tone generator is therefore not activated.

The schematic of the tone generator is shown in FIG. 5. It consists of an oscillator build around CMOS multivibrator 133, industry standard type 4047, a signal conditioner built around CMOS transmission gates 111, 115, and 116, and a power amplifier built around operational amplifier 124, industry standard type 301.

Integrated circuit 133 is connected as a gated astable multivibrator. When the power control output of the comparator is low, the output of the multivibrator is low. When the power control is high the output is a square wave of a frequency determined by resistor 132 and capacitor 131.

The purpose of the signal conditioner circuit is to generate a sine wave of the same frequency as the output of the multivibrator, whose amplitude rises rapidly, but not instantaneously, from zero to a peak value, and thereafter decays exponentially to zero, generating a pleasing "bong."

The active elements in the signal conditioner circuit are three standard CMOS SPDT transmission gates, 111, 115, and 116. The operation of these gates is precisely analogous to an electrically controlled SPDT switch; when the control input is low the input terminal is connected to one output; when the control input is high the input terminal is connected to the other output. An explanation of the symbols used to represent transmission gates is shown in FIG. 6.

Referring again to FIG. 5, it will be seen that when the power control line is low—i.e., the tone generator is turned off—capacitor 112 is connected to V+ through transmission gate 111 and resistor 110, and to Vc (Vc is a voltage midway between V+ and V−, most conveniently obtained from a centertap on the power supply batteries) through transmission gate 116. It is therefore charged to a voltage equal to the difference between V+ and Vc, or about $\frac{1}{2}$ the supply voltage. Capacitor 114 is shorted out through transmission gate 115, resistors 117, 119, 121, and 122, and transmission gate 116, and is therefore completely discharged.

When a tone is initiated the power control goes high, and multivibrator 133 produces a square wave output. Transmission gate 111 connects capacitor 112 to capacitor 114 through resistor 113, and capacitor 114 charges until the voltage across it equals the voltage across capacitor 112. During the low part of the square wave output of the multivibrator the negative terminals of capacitors 112 and 114 are connected to Vc through transmission gate 116, and the positive terminals are connected to resistor 117 through transmission gate 115, producing a voltage at resistor 117 positive with respect to and equal to the voltage across capacitor 114.

During the high portion of the square wave the positive ends of capacitors 112 and 114 are connected to Vc through transmission gate 115, and the negative terminals are connected to resistor 117 through transmission gate 116. This produces a voltage on resistor 117 negative with respect to Vc and equal to the voltage across capacitor 114.

The signal on resistor 117 will therefore be a square wave of an amplitude equal to twice the voltage across capacitor 114 and a frequency equal to the output of the multivibrator. During the course of the tone capacitors 112 and 114 will discharge through resistors 117, 119, 121, and 122, and the amplitude of the square wave will decay exponentially. The rate at which the amplitude rises initially is determined by the values of capacitors 112 and 114, and resistor 113; the rate at which the amplitude decays is determined by capacitors 112 and 114, and resistors 113, 117, 119, and 121.

Resistors 117, 119, and 121, and capacitors 118 and 120 form a passive low pass filter which removes most of the harmonic from the square wave, transforming it into a relatively clean sine wave.

The output of the signal conditioner circuit is fed into a power amplifier formed around operational amplifier 124 and output transistors 125 and 126. The amplifier is connected as an inverting amplifier with the gain set by the ratio of the sum of resistors 117, 119, and 121 to resistor 122. The amplifier is operated with feed forward compensation through capacitor 123 to reduce crossover distortion. Capacitor 134 provides a third pole of low pass filtering to further reduce harmonic content. The output of the amplifier is DC coupled to speaker 127, which is returned to Vc. This is made possible because the output of the signal conditioner is symmetrical around Vc, eliminating any DC offset from Vc on the output.

In order to reduce battery drain to a minimum, power is applied to the operational amplifier through SPST transmission gates 129 and 130 only when the power control is high. The tone generator therefore draws no power at all from the batteries between bongs.

From the foregoing those skilled in the state of the art will readily understand the nature of the invention, the manner in which the method is executed, and the manner in which all the objects set forth are achieved and realized.

The foregoing disclosure is representative of the preferred form of the invention and is to be interpreted in an illustrative rather than a limiting sense, the invention to be accorded the full scope of the claims appended hereto.

I claim:

1. A system for detecting the approach of a person to a selected side of the system but not to the other side of said system, adaptable for use as an automatic doorbell, comprising:

microwave transmitting means for transmitting microwave radiation in the area of the approach to be detected;

spatially selective microwave receiving means for receiving microwave radiation originating in said microwave transmitting means, said microwave receiving means including a shield positioned to face the approach of a person to the system and further including at least one pair of receiving antennas positioned on opposite sides of said shield such that changes in the standing wave patterns surrounding said microwave transmitting means caused by the approach of a person are reflected in changes in the signal strength at the receiving antenna on the side of the shield facing the person, but not in the signal strength at the antenna on the opposite side of said shield;

rectifying means connected to each of said receiving antennas such that a D.C. voltage is produced that is proportional to the amplitude of the signal present at the associated antenna, said D.C. voltage being substantially equal to the peak value of the signal received by the associated antenna;

threshold detector means connected to each of said rectifying means such that a change in the output of said rectifying means exceeding a preset threshold causes the generation by the associated threshold detector means of a logic level signal compatible with CMOS circuitry, said threshold detector means comprising separate CMOS micropower amplifying means responsive to changes in the output voltage of said rectifying means;

digital comparator—timer means connected to said threshold detector means; and indicator means connected to said digital comparator-timer means for providing an indicator signal of the approach of said person on said selected side of said system, said digital comparator-timer means being operative to provide a signal to activate said indicator means only when a signal is received from said threshold detector means connected to the receiving antenna associated with said selected side of said system, said signal being generated by said digital comparator-timer means only after a predetermined period during which neither threshold detector means has generated a signal but not when a signal is generated by the other threshold detector means.

2. The system as in claim 1 wherein said microwave transmitting means is operated in a pulsed mode with a very low duty cycle, allowing a moderate peak power level while reducing the average power consumption to very low levels, making continuous operation off batteries possible.

3. The system as in claim 1 wherein said microwave transmitting means operates in the S band.

* * * * *